US007014096B2

(12) United States Patent
Hinds

(10) Patent No.: US 7,014,096 B2
(45) Date of Patent: Mar. 21, 2006

(54) WALL MOUNTED CLOTHES HAMPER AND SORTER

(76) Inventor: David Roy Hinds, 21550 Box Springs Rd. Apt.#1006, Moreno Valley, CA (US) 92557

( * ) Notice: Subject to any disclaimer, the term of this patent is extended or adjusted under 35 U.S.C. 154(b) by 0 days.

(21) Appl. No.: 10/630,413

(22) Filed: Jul. 29, 2003

(65) Prior Publication Data

US 2005/0023336 A1 Feb. 3, 2005

(51) Int. Cl.
*B65D 91/00* (2006.01)

(52) U.S. Cl. ..... 232/1 B; 160/36; 160/97; 312/297; 312/323; 49/197; 49/145

(58) Field of Classification Search ..... 232/1 B, 232/1 E, 43.1; 220/476; 160/37, 36, 97, 160/92; 312/297, 323, 322; 49/197, 198, 49/128, 145, 143
See application file for complete search history.

(56) References Cited

U.S. PATENT DOCUMENTS

| | | | | | |
|---|---|---|---|---|---|
| 1,800,825 | A | * | 4/1931 | Feltault | 312/242 |
| 1,800,826 | A | * | 4/1931 | Feltault | 312/242 |
| 1,810,563 | A | * | 6/1931 | Katzman | 232/1 B |
| 1,869,807 | A | * | 8/1932 | Hammer | 232/43.5 |
| 1,877,470 | A | * | 9/1932 | Mastrangelo et al. | 312/25 |
| 1,959,790 | A | * | 5/1934 | Katzman | 232/1 B |
| 2,036,794 | A | * | 4/1936 | Derman | 232/43.5 |
| 2,895,782 | A | * | 7/1959 | Fragale | 312/290 |
| D195,279 | S | * | 5/1963 | Taylor | D32/37 |
| 3,351,405 | A | * | 11/1967 | Ferdinand et al. | 312/297 |
| 4,138,504 | A | * | 2/1979 | Mack et al. | 426/520 |
| 5,700,293 | A | | 12/1997 | Rydell | |
| D398,107 | S | | 9/1998 | Ratcliff | |
| 6,019,445 | A | | 2/2000 | Gades | |
| 6,062,416 | A | | 5/2000 | Smillie | |
| D441,928 | S | | 5/2001 | Adams | |
| 6,672,601 | B1 | * | 1/2004 | Hofheins et al. | 280/47.34 |

* cited by examiner

*Primary Examiner*—William L. Miller

(57) ABSTRACT

A hamper/sorter (15) for storing and sorting laundry which loads from the front with one or more openings is described. The hamper/sorter (15) is comprised of the main body and two moveable doors, one upper flexible door (5) that slides vertically and a lower rigid door (4) that can be stowed horizontally under the hamper/sorter (15). During operation, the doors adjust the front openings to allow for small or large laundry items to be loaded and unloaded for storing or washing. The upper and lower door edges that meet together are formed at an angle opposite of each other so that the upper door (5) overlaps the lower door (4). A stop plate (14) is installed on the upper door (5) to keep the doors in the normally closed position. This invention is versatile enough to be used as a hamper or sorter in any location that permits its mounting. One or more of these hamper/sorters (15) can also be mounted together in a horizontal row to provide a sorting system. The size of the invention is about the size of a typical floor hamper and allows for more than one washer load of laundry to be stored.

1 Claim, 2 Drawing Sheets

WALL MOUNTED CLOTHES HAMPER AND SORTER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

The present invention relates generally to devices used for storing and sorting laundry prior to washing.

2. Background of the Invention

Companies and inventers alike have been trying to make a device that would be both attractive and functional which could be used in a variety of places in the home or wherever dirty laundry is gathered. But in the past they have been either pretty or practical.

Currently some of the problems with prior art is the compartment size is limited or designed for one load of laundry. This prior art also doesn't allow for controlling the amount of laundry to be unloaded for washing. Today's modern machines come in different washing capacities and multiple washing load options. Also this prior art has a lower door that could come in contact with the washing machine door on top loading machines.

Another prior art made of netting which is inexpensive and ventilates, but creates a possible risk of buttons and clasps snagging on the netting. This can possibly cause damage to clothes and can be frustrating. I believe no amount of ventilation will help clothes dry, if piled one on top of another wet, as this happens in most households. It will just let the smell of the soiled laundry out. Doing smaller loads sooner will help eliminate this. This prior art has no means to keep the laundry from falling out the front when fully loaded in its above ground version.

Another prior art has elongated door stops that also could risk buttons and clasps snagging on them. This prior art also doesn't eliminate the bending over to put laundry in the washer which other prior art does. Prior art, though somewhat effective in its particular function, isn't very attractive and versatile as well as being functional. Today's consumer, I believe wants both.

BACKGROUND OF THE INVENTION—OBJECTS AND ADVANTAGES

This invention I believe eliminates all prior art problems stated. By adjusting the opening of the front doors it allows a varied amount of clothes, or controls the amount of clothes for storing or washing. The front opening of this invention closes to contain clothes so they won't fall out when it is fully loaded. The lower door can be horizontally stowed under the hamper/sorter to prevent contact with top loading washing machine doors. With no netting or vent holes, except for the top opening, there is little or no risk of snagging with the solid panel construction. The versatility of it being wall mounted allows it to be positioned in a variety of heights and locations which will eliminate it from being too high for children or too low for adults. Plus, it doesn't look like a hamper and this improved appearance adds to its location versatility.

SUMMARY

This invention relates to laundry hampers and sorters. This hamper/sorter has multiple unique front openings. It allows for front loading of laundry through an upper front opening and a lower front opening. The lower opening allows for larger items of laundry to be loaded if desired. The upper opening allows for smaller laundry items to be loaded It is designed to be mounted anywhere it will serve as a hamper or sorter in any location of a building or home where it can be used. As a sorter, one or more can be mounted horizontally and adjacent to each other to form a sorting system. Its design, size and operation are is simple and it will not impede the opening of top loading washers.

DRAWINGS—FIGURES

DRAWINGS—REFERENCE NUMERALS

Figure 1:
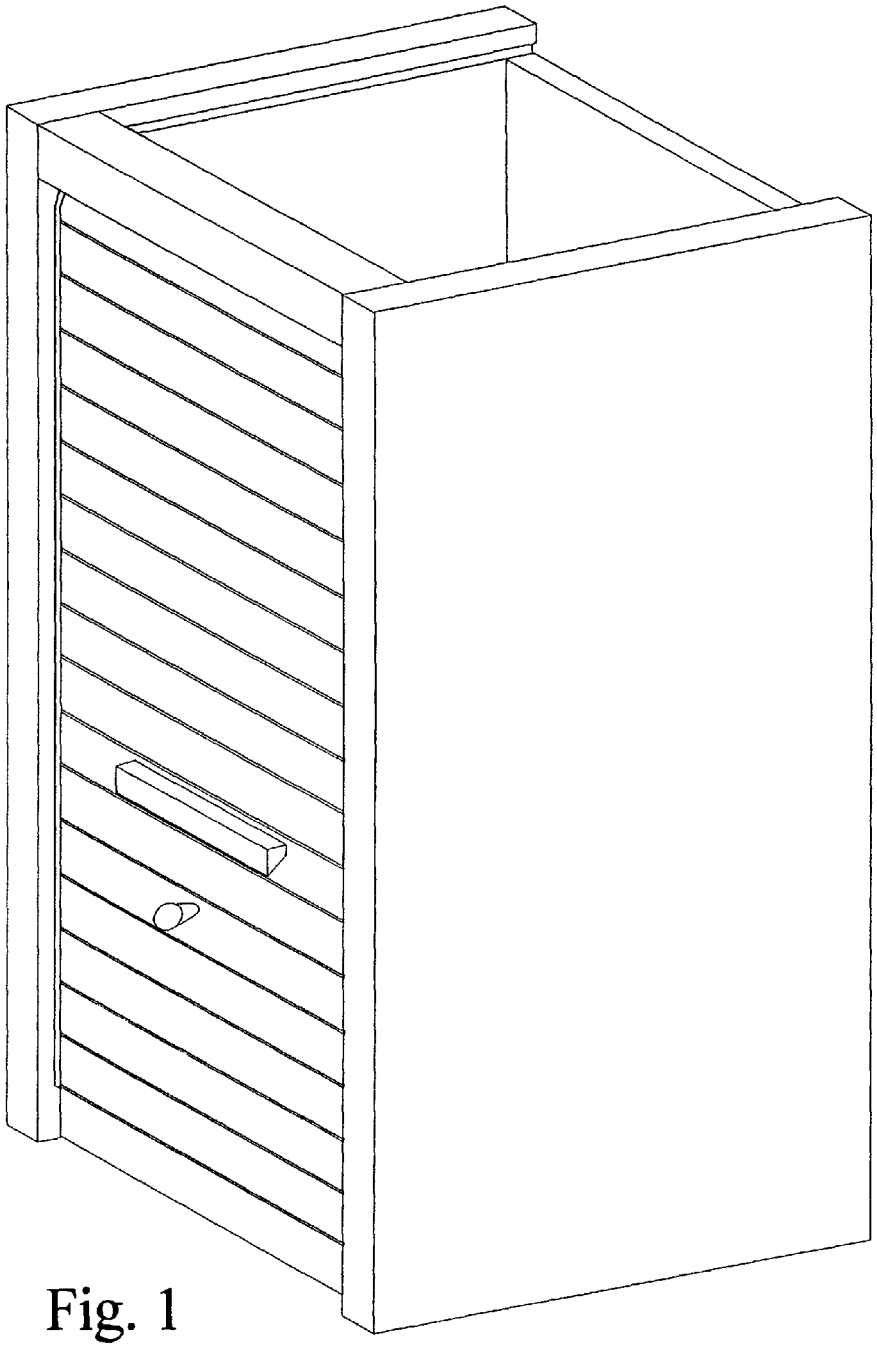
FIG. 1 is a top, side, front view of the Wall Mounted Clothes Hamper and Sorter with the doors in the fully closed position.
Figure 2:
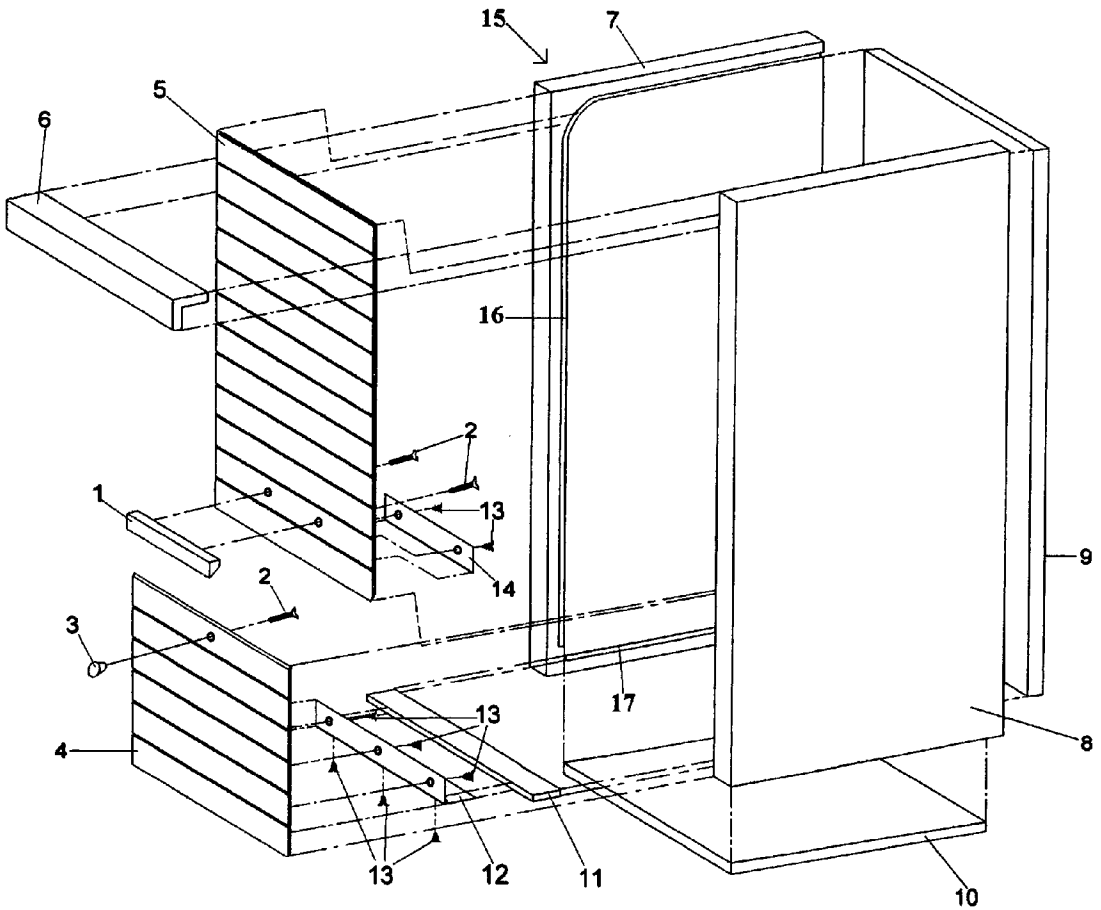
FIG. 2 is also a top, side, front view of the Wall Mounted Clothes Hamper and Sorter with all its separate parts in close proximity of their finale placement.

| | |
|---|---|
| 1 | Upper door handle |
| 2 | Mounting screws |
| 3 | Lower door knob |
| 4 | Lower door |
| 5 | Upper door |
| 6 | Support brace |
| 7 | Right side piece |
| 8 | Left side piece |
| 9 | Back side piece |
| 10 | Bottom piece |
| 11 | Slide guide |
| 12 | Hinge |
| 13 | Mounting screws |
| 14 | Stop plate |
| 15 | Hamper/Sorter |
| 16 | Vertical groove |
| 17 | Horizontal groove |

DETAILED DESCRIPTION—FIGS. 1 AND 2—PREFERED EMBODIMENT

With reference to the drawings, figure one is a view of the top, side, and front of the hamper/sorter 15 with the upper 5 and lower 4 doors closed and engaged. In figure two an exploded view is shown of all the parts and their placement from a top, front, side perspective. In reference to the figures, height is top to bottom, width is side to side, and length is front to back. Thickness is the density of each part.

The main parts of the hamper/sorter 15 are the bottom piece 10, left side piece 8, right side piece 7, back side piece 9, upper door 5, lower door 4 and the support brace 6.

The bottom piece 10 is a solid panel slightly thinner than the back piece 9. The bottom piece 10 is fastened horizontally on the inside of the side pieces 7&8 just above the horizontal groove 17. The bottom piece back edge is positioned flush with the back edge of the side pieces 7&8. The side pieces 7&8 and back 9 piece are all solid panels of the same thickness.

The side pieces 7&8 have two grooves in them, the horizontal groove 17 and the vertical groove 16. The vertical groove 16 starts near the bottom front corner on the inside of the side pieces 7&8. It goes up and curves at the top front corner and out the back of the side pieces 7&8. The horizontal groove 17 starts near the bottom front corner and goes horizontally out the back of the side pieces 7&8. Each groove is wide and deep enough to allow for placement and operation of the upper door 5 and the slide guide 11 of the lower door 4 in the side pieces 7&8.

The back piece 9 is fastened vertically inside and is flush with the rear edge of the side pieces 7&8. The back piece 9 lower end fits just above the horizontal groove 17, and the upper end just beneath the horizontal portion of the vertical groove 16 of the side pieces 7&8.

The support brace 6 is a 90 degree angle piece that's width is the same as the width of the back piece 9. Its length and height are equal, and its thickness is the same as the bottom piece 10. The support brace 6 is fastened inside and flush with the upper front corners of the side pieces 7&8.

The upper door 5 is taller than the lower door 4 and both are tall enough, when engaged together, to cover the front opening of the hamper/sorter 15. The upper door 5 is thin enough to fit into the vertical groove 16 and just a little wider than the back piece 9. It is also flexible so it can slide the full length of the vertical groove 16. The lower end edge of the upper door 5 is shaped at an angled to overlap the lower doors 4 top end edge. The upper door 5 has a stop plate 14 attached with mounting screws 13 on the inside of the door. The stop plate 14 is centered and is flush with the lower edge of the upper door 5. This stop plate keeps the lower door 4 in place when the ends of the doors 4&5 are fully engaged and closed. The upper door 5 is installed into the vertical groove horizontal portion 16 from the back before the hamper/sorter 15 is mounted.

The lower door 4 is rigid and its upper end edge is shaped at an angled opposite of the upper doors 5 lower edge so the ends match when engaged together. The lower doors 4 width is slightly smaller than the back piece 9. This allows the lower door 4 to move freely in between the side pieces 7&8 when being opened and closed. The lower door 4 has a hinge 12 with one of its sides attached on the inside of the lower door 4. The hinge 12 is centered on the lower door 4 near the lower edge with mounting screws 13. The other side of the hinge 12 has a slide guide 11 attached with mounting screws 13. The slide guide 11 is centered and on top of the hinge 12. The hinge 12 allows the lower door 4 to be moved from the vertical position to the horizontal position and vise versa. The slide guide 11 fits into the horizontal groove 17 through the lower back end of the side pieces 7&8. This allows the lower door 4 to be moved horizontally and or stowed under the invention.

The slide guide 11 is as wide and as thick as the upper door 5. It is just long enough to provide stability for the lower door 4 as it slides in the horizontal groove 17. The lower door 4, hinge 12, and slide guide 11 are assembled together and installed from the back through the horizontal groove 17 before the hamper/sorter 15 is mounted.

The handle 1 and knob 3 for the doors 4&5 are mounted with screws 2 for door operation. The hamper/sorter 15 can be made of any lightweight materiel that can be fastened together or molded together. The dimensions, sizes, thickness, width, height, and depth of the invention can be adjusted or customized as desired.

Operation

With one or more hamper/sorters 15 mounted on a wall, the user would be standing as close as possible to the hamper(s); the procedures will be as follows:

Upper front loading (with all doors closed)—With one hand on the handle 1 of the upper door 5 lift it up enough to allow lower door 4 to be opened out. With the other hand, grab the lower door 4 knob 3 and open the lower door 4 out towards the operator to the fully down and horizontal position. Push the lower door 4 towards the hamper/sorter 15 until the door is under the hamper/sorter 15 or it stops and let go of the knob 3. With the other hand still on the upper door 5, push down gently on the handle 1 of the upper door 5 until it stops and let go of handle 1. There will be an opening just above the upper door 5. Toss in desired amount of laundry in the opening above the upper door 5. To close, make sure no laundry falls out or impedes door operation through the lower opening. With one hand on the handle 1 of the upper door 5, lift the upper door 5 high enough to allow the lower door 4 to be close. Grab the lower door 4 knob 3 and pull the lower door 4 towards the operator until it stops. Raise the lower door 4 to the vertical and closed position. Make sure again that no laundry is exposed and reengage the two doors 4&5 and let go of the handle 1 and knob 3.

Lower front loading (with all doors closed)—With one hand on the handle 1 of the upper door 5 lift it up enough to allow lower door 4 to be opened out. With the other hand, grab the lower door 4 knob 3 and open the lower door 4 out towards the operator to the fully down and horizontal position. Push the lower door 4 towards the hamper/sorter 15 until the door is under the hamper/sorter 15 or it stops and let go of the knob 3. With the other hand still on the upper door 5, lift up on the handle 1 of the upper door 5 until it stops or desired opening is achieved for loading laundry, let go of handle 1. To close, make sure no laundry falls out or impedes door operation through the lower opening. With one hand grab the lower door 4 knob 3 and pull out lower door 4 towards the operator until it stops. Raise the lower door 4 to the vertical and closed position. Grab upper door handle 1 with the other hand, again making sure that no laundry is exposed, and slide down the upper door 5 until it engages the lower door 4 let go of handle 1 and knob 3.

To unload laundry (with all doors closed)—With one hand on the handle 1 of the upper door 5, slide upper door 5 up to desired height and let go of handle 1. With the other hand, grab the lower door 4 knob 3 and open the lower door 4 out towards the operator to the fully down and horizontal position. Push lower door 4 towards hamper/sorter 15 until it stops and let go of knob 3. Unload desired amount of laundry and close doors in reverse order.

ALTERNATIVE EMBODIMENT

The bottom piece 10, back side piece 9, side pieces 7&8, and support brace 6 can be combined as one piece, through a process of extrusion using a lightweight material thus eliminating the fastening process. In this same embodiment and method the upper door 5, handle 1, stop plate 14 can be combined as one part through the same extrusion process as stated above, eliminating the screws. In this same embodiment and method the lower door 4, hinge 12, lower door slide guide 11, lower door knob 3 can be combined as one part through the same extrusion process as stated above, eliminating the hinge 12 and the mounting screws 2 and 13.

The operating procedures would be the same as for the preferred embodiment.

CONCLUSION, RAMIFICATIONS, AND SCOPE

In Conclusion, by adjusting the opening of the front doors, a varied load size can be loaded and unloaded for controlling the amount of clothes removed for storing or washing. The front opening closes and contains laundry so it won't fall out when it is full. The lower door can be stowed under the hamper to prevent any contact with a washing machine. Without netting, there is no or very low risk of snagging with the solid panel construction. The versatility of it being wall mounted allows it to be used in a variety of locations. Plus its improved appearance adds to its location versatility in a home or workplace.

Accordingly, the scope of the invention should be determined not by the embodiments illustrated, but by the appended claims and their legal equivalents.

I claim:

1. A method for loading, unloading and storing laundry until its ready for laundering comprising:

mounting a hamper to a wall in any desired location in a building, said hamper having a mounting surface for attachment to said wall and a front opening closed by independently movable upper and lower front doors, a lower end edge of said upper door overlapping an upper end edge of said lower door when said front opening is closed, said upper door slidably mounted to said hamper and said lower door pivotably and slidably mounted to said hamper;

loading or unloading said laundry into or from said hamper by sliding said upper door upwardly to allow said lower door to pivot outwardly to an open horizontal position, sliding said lower door into said hamper in said horizontal position, sliding said upper door upwardly or downwardly to expose a desired portion of said front opening, and loading or unloading said laundry through said portion of said front opening.

* * * * *